US012312980B2

(12) United States Patent
Zampieri

(10) Patent No.: US 12,312,980 B2
(45) Date of Patent: May 27, 2025

(54) PLANT AND PROCESS OF CONVERTING THERMAL ENERGY INTO MECHANICAL AND/OR ELECTRICAL ENERGY

(71) Applicant: STAR ENGINE S.R.L., Negrar (IT)

(72) Inventor: Gino Zampieri, Verona (IT)

(73) Assignee: Star Engine S.R.L., Negrar (IT)

( * ) Notice: Subject to any disclaimer, the term of this patent is extended or adjusted under 35 U.S.C. 154(b) by 0 days.

(21) Appl. No.: 18/292,594

(22) PCT Filed: Jul. 27, 2022

(86) PCT No.: PCT/IB2022/056916
§ 371 (c)(1),
(2) Date: Jan. 26, 2024

(87) PCT Pub. No.: WO2023/007380
PCT Pub. Date: Feb. 2, 2023

(65) Prior Publication Data

US 2025/0075640 A1 Mar. 6, 2025

(30) Foreign Application Priority Data

Jul. 27, 2021 (IT) ..... 102021000019994

(51) Int. Cl.
*F01K 17/04* (2006.01)
*F01K 25/08* (2006.01)

(52) U.S. Cl.
CPC ..... *F01K 17/04* (2013.01); *F01K 25/08* (2013.01)

(58) Field of Classification Search
CPC ..... F01K 17/04; F01K 25/08
See application file for complete search history.

(56) References Cited

U.S. PATENT DOCUMENTS 4,266,404 A * 5/1981 ElDifrawi ..... F02G 5/00 62/238.4
5,461,858 A 10/1995 Johnson
(Continued)

FOREIGN PATENT DOCUMENTS

DE 102016113007 1/2017
DE 102015224416 6/2017
(Continued)

OTHER PUBLICATIONS

International Search Report and Written Opinion for PCT/IB2022/056916 dated Dec. 22, 2022 (10 pages).

*Primary Examiner* — Hoang M Nguyen
(74) *Attorney, Agent, or Firm* — Mueting Raasch Group

(57) ABSTRACT

The present invention relates to a process and plant (1) for converting thermal energy into electrical and/or mechanical energy. The plant includes a closed circuit (2), a pump (13) to circulate the working fluid in the closed circuit (2), an evaporator (3) to heat the working fluid to cause it to change from a liquid to a gaseous state, a volumetric expander (4) operating in the closed circuit (2) downstream of the evaporator (3) and configured to receive working as an input fluid in the gaseous state, a condenser (16) operating on the closed circuit (2) downstream of the volumetric expander (4) and upstream of the pump (13) to condense the working fluid determining its transition from the gaseous to the liquid state. The pump (13) in turn comprises a first compartment positionable in fluid communication with a first portion (2*a*) of the closed circuit (2), extending downstream of the pump (13) and upstream of the evaporator (3), to send working fluid in the liquid state to the same evaporator (3), and a second compartment that may be positioned in fluid communication with a second portion (2*b*) of the closed circuit, extending upstream of the volumetric expander (4) and downstream of said first portion (2*a*), to receive working (Continued)

fluid in the gaseous state generated by the evaporator (3). The working fluid in the gaseous state expands the second compartment and causes a volume reduction of the first compartment by promoting the pumping of the working fluid in the liquid state to the evaporator (3).

21 Claims, 4 Drawing Sheets

(56) References Cited

U.S. PATENT DOCUMENTS

| | | | | |
|---|---|---|---|---|
| 2004/0144093 | A1* | 7/2004 | Hanna | F01K 17/02 60/671 |
| 2017/0058701 | A1* | 3/2017 | Guo | F01K 23/064 |
| 2020/0308967 | A1* | 10/2020 | Zampieri | F01B 1/062 |

FOREIGN PATENT DOCUMENTS

| | | |
|---|---|---|
| EP | 3056694 | 8/2016 |
| WO | WO 2016/144233 | 9/2016 |
| WO | WO 2017/187112 | 11/2017 |

* cited by examiner

PLANT AND PROCESS OF CONVERTING THERMAL ENERGY INTO MECHANICAL AND/OR ELECTRICAL ENERGY

This application is the § 371 U.S. National Stage of International Application No. PCT/IB2022/056916, filed Jul. 27, 2022, which claims the priority to Italian Application No. 102021000019994 filed Jul. 27, 2021, the disclosures of which are incorporated by reference herein in their entireties.

FIELD OF THE INVENTION

The object of the present invention is a plant and a related process in which a working fluid performs a thermodynamic cycle, specifically a closed thermodynamic cycle, e.g., a Rankine cycle, for the generation of electrical and/or mechanical power by the recovery and conversion of heat from a hot source. In particular, the plant and process covered by the invention can achieve a self-sustaining cycle that therefore does not require power supply to the working fluid pumping system (or requires minimal power supply) to operate.

In addition, the process and plant described and claimed here are capable of efficiently extracting energy even from 'hot' sources characterized by not excessively high temperatures, e.g., below 130° C., particularly hot sources in which a liquid (typically water) is present at temperatures below 100° C., e.g., between 35 and 80° C.

The present invention can be used in biogas/biomass plants for the recovery of waste heat from the cogeneration process, in geothermal plants for the exploitation of medium/small heat sources, in industrial plants for the recovery of waste heat (conversion of waste heat from industrial processes), and in the household for the production of electricity and the exploitation of heat for sanitary use.

A further use of the expander and its plant may concern systems, both domestic and industrial, in which the heat source is provided by solar energy capture systems.

Uses of the plant in the automotive sector, for example, for heat recovery from the engine, can also be envisaged.

STATE OF THE ART

Plants employing piston, screw, scroll volumetric expanders or reactive expanders such as gas turbines are known to recover thermal energy and subsequently produce electricity.

A popular form of implementation of such plants involves the use of one or more turbines as an expansion chamber. However, this solution has some constraints and drawbacks, such as:

- high cost of the turbine and related control organs;
- need for frequent maintenance with consequent burdens;
- need to have a working fluid always at very high temperatures and always in a gaseous state, otherwise the turbines themselves will be irreversibly damaged;
- maximum efficiency that can be obtained only at a very precise flow rate of the expanding fluid and with a defined rotational speed; in particular, this is perhaps the greatest limitation of turbine systems in that
- if the rotational speed undergoes even a slight variation from the optimal value, the efficiency of the turbine drops dramatically.

It should also be noted that countless currently potentially available heat sources (think of industrial wastewater, or plant cooling water) have a temperature that is not excessively high, often significantly below 100° C., and flow rates that vary over time. The conversion into electricity of the heat provided by such sources, through the employment of turbines, is not cost-effective in relation to the energy produced: turbines are in fact unsuitable for the exploitation of medium/low-temperature heat sources (e.g., between 35 and 90° C.) which, moreover, often have widely variable heat output, a condition that makes the employment of turbines for thermal energy conversion even more inconvenient.

To overcome the drawbacks described above, it is known to use volumetric expanders, either reciprocating or rotary, capable of extracting energy from sources at not excessively high temperatures and also capable of operating at relatively modest fluid flow rates without excessive reduction in efficiency.

Examples of alternative (e.g., single- or multi-piston) volumetric expander plants used for the conversion of thermal energy into mechanical and/or electrical energy-capable of using heat sources at temperatures that may be below 100° C., e.g., on the order of 35-130° C.—are described in patent applications WO2010102874 and WO2014141072. Although these known alternative plants are found to be improved over plants with conventional turbines particularly under the mentioned medium/low-temperature heat source conditions, the Applicant has identified additional aspects that can be improved.

In particular, plants with a working fluid circulating in a closed loop require a pumping system to circulate the same working fluid. The pumps currently used are typically powered by electricity and thus put a burden on the overall efficiency of the system because a fraction of the mechanical and/or electrical energy that can be generated by the system is actually consumed by the pump.

In addition, currently used pumps such as multi-stage centrifugal pumps, vane pumps, gear pumps or orbital screw or spiral pumps (scroll type) have shown poor efficiencies, leakage problems at the high pressure regimes typical of the thermodynamic cycles discussed here, as well as all being subject to major cavitation problems.

OBJECT OF THE INVENTION

The object of the present invention is therefore to substantially solve at least one of the drawbacks and/or limitations of the preceding solutions.

A first objective of the present invention is to make available a high-efficiency plant and process, particularly one that allows high efficiencies to be achieved through conversion of thermal energy into mechanical and/or electrical energy even while operating with hot sources at medium/low temperatures (e.g., on the order of 35 to 130° C.).

It is also a purpose of the present invention to make available a plant and a related process, e.g., of Rankine cycle type, that can be adapted to different working conditions so that the available heat sources can be effectively utilized and the maximum power can be delivered with excellent efficiencies.

It is then a purpose of the present invention to make available a plant and a related process, e.g., of Rankine cycle type, of simple and compact construction suitable for easy deployment and consequently exhibiting extremely low production, maintenance and assembly costs.

It is also an objective of the invention to provide a plant and related process, such as of Rankine cycle type, in which the working fluid pumping system is improved in efficiency.

It is also an additional purpose, to offer a plant and process that can achieve a self-sustaining cycle that therefore does not require power supply to the working fluid pumping system (or that requires minimal power supply) to operate.

An additional purpose of the invention is making available a plant and a related process, e.g., of Rankine cycle type, in which the working fluid pumping system does not show reliability problems and is well suited for use at pressure regimes of the cycle described here and with a working fluid present in both gaseous and liquid states.

It is also an ancillary purpose of the invention to make available a plant and process using a pumping system that minimizes cavitation issues.

Finally, it is an objective of the present invention to make available a plant and process for converting thermal energy into electrical and/or mechanical energy that is easily implemented and through which excellent energy conversion efficiencies can be achieved.

These purposes and others, which will appear more from the following description, are substantially achieved by a volumetric expander, a closed-loop plant, and a process for converting thermal energy to electrical energy according to one or more of the appended claims and/or the following aspects, taken alone or in any combination with each other or in combination with any one of the claims and/or in combination with any one of the additional aspects or features described below.

SUMMARY

Aspects of the invention are described below.

In a 1st aspect, a plant (1) is provided comprising:

a closed circuit (2) for the circulation of at least one working fluid, at least one pump (13) operative in the closed circuit (2) and arranged to circulate the working fluid in the circuit itself, at least one expander (4) configured to receive as input the working fluid in the gaseous state, wherein the pump comprises at least one first compartment (20) positionable in fluid communication with a first portion (2*a*) of the closed circuit (2), extending downstream of the pump (13), to propel working fluid in a liquid state in the closed circuit towards said first portion, and at least one second compartment (21) positionable in fluid communication with a second portion (2*b*) of the closed circuit, extending downstream of said first portion (2*a*) and upstream of the expander (4), to receive working fluid in the gaseous state present in said second portion of the closed circuit.

In a 2nd aspect, optionally according to the 1st aspect, a plant (1) is provided comprising:

a closed circuit (2) for the circulation of at least one working fluid, at least one pump (13) operating in the closed circuit (2) and arranged to circulate the working fluid in the closed circuit itself, at least one evaporator (3) active on the closed circuit (2) and configured to receive heat from a hot source (H) and heat the working fluid to cause in its transition from liquid to gaseous state, at least one expander (4) operating in the closed circuit (2) downstream of the evaporator (3) and configured to receive as input working fluid in the gaseous state, at least one condenser (16) active on the closed circuit (2) downstream of the expander (4) and upstream of the pump (13), said condenser (16) being configured to condense the working fluid by determining its transition from the gaseous to the liquid state, wherein the pump (13) includes:

at least a first compartment (20) configured to be positioned in fluid communication with a first portion (2*a*) of the closed circuit (2), extending downstream of the pump (13) and upstream of the evaporator (3), to send working fluid in the liquid state to the same evaporator (3), and at least a second compartment (21) configured to be positioned in fluid communication with a second portion (2*b*) of the closed circuit, extending downstream of said first portion (2*a*) and upstream of the expander (4), to receive working fluid in the gaseous state generated by the evaporator (3).

In a 3rd aspect according to any one of the preceding aspects, the expander (4) is a volumetric expander with one or more pistons (reciprocating or rotating), screw, scroll, or other type.

In a 4th aspect according to any one of aspects 1st or 2nd the expander (4) is a reaction expander, including one or more gas turbines.

In a 5th aspect according to any one of the preceding aspects, the plant is configured for converting thermal energy to electrical and/or mechanical energy.

In a 6th aspect according to any one of the preceding aspects, the pump is configured for determining an increase in volume of the second compartment (21) following the entry of said working fluid in a gaseous state coming from the second portion (2*b*) into the same second compartment (21), and consequently promoting a reduction in the volume of the first compartment (20) causing the transfer of working fluid in a liquid state towards said evaporator (3).

In a 7th aspect according to any one of the preceding aspects, the first compartment (20) is selectively configurable in a respective first operating condition, wherein said first compartment (20) is in fluid communication with the first portion (2*a*) of the closed circuit (2), and in a respective second operating condition, wherein the first compartment (20) is in fluid communication with a third portion (2*c*) of the closed circuit (2), extending downstream of the condenser (16) and upstream of the pump (13), to receive working fluid in a liquid state from the condenser (16).

In an 8th aspect according to any one of the preceding aspects, the second compartment (21) is selectively configurable in a respective first operating condition, wherein said second compartment (21) is in fluid communication with the second portion (2*b*) of the closed circuit (2), and in a respective second operating condition, wherein the second compartment (21) is in fluid communication with the third portion (2*c*) of the closed circuit (2) upstream of the pump (13) to discharge working fluid in a gaseous state into said third portion (2*c*).

In a 9th aspect according to any one of the preceding two aspects, the plant is configured to hold the first compartment (20) in the respective first operating condition when the second compartment (21) is in the respective first operating condition and to hold the first compartment (20) in the respective second operating condition when the second compartment (21) is in the respective second operating condition.

In a 10th aspect according to any one of the preceding aspects, the plant includes at least one collection tank (17) operating at the or a third portion (2*c*) of the closed circuit (2) and interposed between the condenser (16) and the pump (13), said collection tank (17) being configured to receive working fluid from the condenser (16) and to contain working fluid in the liquid state in equilibrium with working fluid in the gaseous state.

In an 11th aspect according to the preceding aspect, the first compartment (20), in the respective second operating condition, is in fluid communication with a zone of the collection tank (17), in particular a lower zone (17*a*) of the collection tank, wherein working fluid in liquid state is present to receive working fluid in liquid state from the collection tank.

In a 12th aspect according to any one of the preceding two aspects, the second compartment (21), in the respective second operating condition, is in fluid communication with a zone of the collection tank (17), in particular an upper zone (17*b*) of the collection tank, wherein working fluid in gaseous state is present, to discharge working fluid in the gaseous state into the collection tank.

In a 13th aspect according to any one of the preceding aspects the pump (13) includes a casing and at least one piston operating within the casing.

In a 14th aspect according to the preceding aspect, the piston has a first head delimiting, in cooperation with said casing, the first compartment (20), and a second head delimiting, in cooperation with said casing, the second compartment (21).

In a 15th aspect according to the preceding aspect the first and second heads are connected to each other.

In a 16th aspect according to the preceding aspect the first and second heads are rigidly connected.

In a 17th aspect according to the 15th or 16th aspect the first and second heads are connected to each other so that:

when said first compartment (20) and said second compartment (21) are each in their respective first operating condition, gaseous working fluid generated by the evaporator (3) entering said second compartment (21) contributes to move the second head of said piston, also determining the movement of said first head and the expulsion of liquid working fluid from the first compartment (20) and sending the same towards said evaporator (3).

In an 18th aspect according to the 15th or 16th or 17th aspect the first and second heads are connected to each other so that:

when said first compartment (20) and said second compartment (21) are each in their respective second operating condition, liquid working fluid entering said first compartment (20) contributes to move the first head of said piston, determining also the movement of said second head and the expulsion of working fluid in the gaseous state from the second compartment (21) and the sending of the same towards a/third portion (2*c*) of the closed circuit (2), extending downstream of the condenser (16) and upstream of the pump (13).

In a 19th aspect according to any one of the four preceding aspects, the pump includes a driving member, optionally including an electric motor or hydraulic motor or electric actuator or hydraulic actuator or pneumatic actuator, active on said piston to cause it to move back and forth along a predetermined stroke within said casing.

In a 20th aspect according to any one of aspects from the 15th to the 18th, the enclosure defines at least a first and a second working chamber hydraulically separated from each other and each defining a respective volume that can be occupied by the working fluid, and where the volumetry of the second chamber is greater than the volumetry of the first chamber.

In a 21st aspect according to the preceding aspect, the volumetry of the second chamber is at least 1.5 times greater than the volumetry of the first chamber, e.g. 1.5 times, 1.75 times, 2 times, 2.25 times, 2.5 times, 2.75 times, 3 times greater than the volumetry of the first chamber.

In a 22nd aspect according to the 20th or 21st aspect, the first and second chambers have equal axial extension, i.e., equal extension in the direction of piston motion, and different cross section.

In a 23rd aspect according to the 20th or 21st or 22nd aspect, the first piston head is slidingly housed in the first chamber and the second piston head is slidingly housed in the second chamber.

In a 24th aspect according to the preceding aspect, the first and second heads are rigidly connected, and the first head has an active cross-sectional area smaller than that the second head.

In a 25th aspect according to the preceding aspect, the first and second heads are rigidly connected by a rod extending transversely to the same first and second heads and passing fluid-tight through a separating wall between the first and second chambers.

In a 26th aspect according to any one of the aspects from the 20th to the 25th, the first piston head separates the first chamber into said first compartment (20) and into a third compartment (22) of the pump, said first and third compartments (22) extending on opposite sides of the first piston head and presenting variable volume as the position of the first head in the first chamber varies.

In a 27th aspect according to any one of the aspects from the 20th to the 26th, the second piston head separates the second chamber into said second compartment (21) and into a fourth compartment (23) of the pump, said second and fourth compartments (23) extending on opposite sides of the second piston head and presenting variable volume as the position of the second head in the second chamber varies.

In a 28th aspect according to any one of the 26th or 27th aspects the first compartment (20) is adjacent to the third compartment (22) which is adjacent to the fourth compartment (23) which in turn is adjacent to the second compartment (21).

In a 29th aspect according to any one of the 26th or 27th or 28th aspects, the third compartment (22) is in fluid communication with the third portion (2*c*) of the closed circuit (2) upstream of the pump (13), in particular with an upper zone of the collection tank (17), wherein working fluid in the gas phase is present.

In a 30th aspect according to any one of aspects 26th or 27th or 28th or 29th the fourth compartment (23) is selectively configurable in a respective first operating condition, wherein said fourth compartment (23) is in fluid communication with the second portion (2*b*) of the closed circuit (2), and in a respective second operating condition, wherein the fourth compartment (23) is in fluid communication with the third portion (2*c*) of the closed circuit (2) upstream of the pump (13), in particular with an upper zone of the collection tank (17), wherein working fluid in gaseous phase is present to discharge working fluid in gaseous state into said third portion (2*c*).

In a 31st aspect according to any one of aspects 26th or 27th or 28th or 29th or 30th the plant (1) is configured to hold the fourth compartment (23) in the respective second operating condition when the second compartment (21) is in the respective first operating condition and hold the fourth compartment (23) in the respective first operating condition when the second compartment (21) is in the respective second operating condition.

In a 32nd according to any one of the above aspects including at least one valve assembly (50) cooperating with the pump (13).

In a 33rd aspect according to the preceding aspect, the valve assembly (50) is configured to:

set the first compartment (20) of the pump (13) selectively in the respective first or second operating condition;

set the second compartment (21) of the pump (13) selectively to the respective first or second operating condition.

In a 34th aspect according to the preceding aspect, the valve assembly (50) is configured to place the first compartment (20) of the pump (13) in the respective first operating condition when the second compartment (21) is in the respective first operating condition and to place the first compartment (20) in the respective second operating condition when the second compartment (21) is in the respective second operating condition.

In a 35th aspect according to the 32nd or 33rd or 34th aspect the valve assembly (50) includes:

a first non-return valve (51), optionally operating on the first portion (2*a*) of the closed circuit (2), to allow supply to said evaporator (3) of working fluid in liquid state exiting from the first compartment (20).

In a 36th aspect according to the preceding aspect, the valve assembly (50) includes:

a second non-return valve (52), optionally operating on the third portion (2*c*) of the closed circuit (2), to allow entry into the first compartment (20) of working fluid in liquid state coming from the same third portion (2*c*).

In a 37th aspect according to the 35th or 36th aspect, the valve assembly (50) includes:

a third non-return valve (56), optionally operating on a service line (32) connecting the second compartment (21) with the second portion (2*b*) of the closed circuit (2), to allow entry of working fluid in gaseous state generated by the evaporator (3) into the second compartment (21).

In a 38th aspect according to the 35th or 36th or 37th aspect, the valve assembly (50) includes:

a fourth non-return valve (57), optionally operating on a further service line (33) connecting the second compartment (21) with the third portion (2*c*) of the closed circuit (2), to allow discharge of working fluid in gaseous state from the second compartment (21) into the same third portion (2*c*) of the closed circuit.

In a 39th aspect according to any one of the aspects from the 32nd to the 34th, the valve assembly (50) is further configured to:

place the fourth compartment (23) selectively in the respective first operating condition or second operating condition, and to place the fourth compartment (23) in the respective second operating condition when the second compartment (21) is in the respective first operating condition, vice versa placing the fourth compartment (23) in the respective first operating condition when the second compartment (21) is in the respective second operating condition.

In a 39th-bis aspect according to any one of the aspects from the 32nd to 34th or the 39th aspect, the valve assembly (50) includes:

a first non-return valve (51), optionally operating on the first portion (2*a*) of the closed circuit (2), to allow supply to said evaporator (3) of working fluid in liquid state exiting from the first compartment (20).

In a 40th aspect according to any one of the aspects from the 32nd to the 34th or the 39th or the 39th-bis aspect, the valve assembly (50) includes:

a second non-return valve (52), optionally operating on the third portion (2*c*) of the closed circuit (2), to allow entry into the first compartment (20) of working fluid in liquid state coming from the same third portion (2*c*).

In a 41st aspect according to any one of the aspects from the 32nd to the 34th or the 39th or the 39th-bis or the 40th aspect the valve assembly (50) includes:

a selector switch (53) having at least four ways and two positions which, in a first position, sets the fourth compartment (23) in the respective second operating condition while simultaneously setting the second compartment (21) in the respective first operating condition, and which selector switch (53), in a second position, sets the fourth compartment (23) in the respective first operating condition while simultaneously setting the second compartment (21) in the respective second operating condition.

In a 42nd aspect according to any one of the preceding aspects, the plant includes a level sensor (3*c*) associated with the evaporator (3).

In a 43rd aspect according to any one of the preceding aspects, the plant includes a level sensor (17*c*) associated with the tank (17).

In a 44th aspect according to any one of the two preceding aspects comprising a control unit (100) communicatively connected with the level sensor (3*c*) associated with the evaporator, said level sensor sending at least a corresponding signal relative to the level of liquid in the evaporator (or of the level of liquid in a liquid collection compartment associated with the evaporator) to the control unit (100) which is configured to receive said signal and, depending on said signal, control or not the activation of the pump (13), for example by operating on the positioning of said selector (53) or by activating said driving member (70) on the basis of at least said signal.

In a 45th aspect according to any one of the three preceding aspects comprising a control unit (100) communicatively connected with the level sensor (17*c*) associated with the tank, said level sensor sending at least a corresponding signal relative to the level of liquid in the tank to the control unit (100) which is configured to receive said signal and, depending on said signal, to control or not the activation of the pump (13), for example by operating on the positioning of said selector (53) or activating said driving member (70) on the basis of at least said signal.

In a 46th aspect according to any one of the preceding aspects, the plant includes at least one end-stroke sensor (60) associated with said pump for detecting the attainment by said piston (15) of respective end-stroke positions.

In a 47th aspect according to the preceding aspect, the end-stroke sensor is configured to directly control the reversal of the motion of said piston, e.g. by sending a command signal to said selector or driving member.

In a 48th aspect according to the 46th or 47th aspect, the end-stroke sensor is configured to emit a corresponding command signal for a/the control unit (100) which is configured to command the reversal of the motion of said piston (15), for example, by operating on the positioning of said selector (53) or by commanding the activation of said driving member (70).

In a 49th aspect according to any one of the preceding aspects a/said control unit (100) is configured to control the reversal of the motion of said piston (15), for example by operating on the positioning of said selector (53) or by controlling the activation of said driving member (70), at predetermined regular time intervals.

In a 50th aspect according to any one of the preceding aspects said evaporator (3) includes at least a first heat exchanger having a side configured to receive heat from a hot source (H) and a side crossed by said second portion (2*b*) of the closed circuit.

In a 51st aspect according to any one of the preceding aspects, the condenser (16) includes at least a second heat exchanger having a side crossed by a section of a/the third portion (2*c*) of the closed circuit (2) interposed between the expander (4) and the pump (13), and a side configured to interact with a cold source (C) and allow condensation of the working fluid crossing said section, determining its passage from the gaseous state to the liquid state.

In a 52nd aspect according to the preceding two aspects, the plant includes at least a third heat exchanger (18) having a side crossed by a section of the closed circuit interposed between the expander (4) and the condenser (16) and a side crossed by a section of the first portion (2*a*) of the closed circuit, in order to determine a preheating of the working fluid in the liquid state exiting the pump (13) and directed towards the evaporator (3).

In a 53rd aspect according to any one of the preceding aspects, the plant is configured to implement a closed Rankine cycle.

In a 54th aspect according to any one of the preceding aspects, the plant is configured to drive a/the pump without the use of electricity.

In a 55th aspect according to any one of the preceding aspects, the plant is energy self-sustaining, in the sense that apart from the hot source and the cold source it does not use energy supply from other sources to operate.

In a 56th aspect according to any one of the preceding aspects, the plant includes at least one electric power generator (12) connected to a main shaft (11) of the volumetric expander (4), said generator (12) being configured to generate electric energy as a result of the rotation of the main shaft (11).

In a 57th aspect according to any one of the preceding aspects said volumetric expander (4) includes:

- at least one piston (5) defining an expansion chamber (6) with variable volume,
- a main shaft (11) kinematically connected to the piston (5) and configured to turn about a main axis,
- at least one valve (8) configured to selectively open and close an inlet and an outlet (9, 10) to the expansion chamber (6).

In a 58th aspect according to the preceding aspect said valve (8) is configured and controlled to allow at least:

- a working fluid input condition into the expansion chamber (6),
- a condition of expansion of the working fluid in the expansion chamber (6), and
- a condition of discharge of the working fluid from said expansion chamber (6).

A 59th aspect concerns a process for converting thermal energy into electrical energy using a plant according to any one of the preceding aspects.

A 60th aspect concerns a process for converting thermal energy into mechanical energy using a plant according to any one of the preceding aspects from the 1st to 58th.

In a 61st aspect, in particular according to the 59th or 60th aspect, a process is provided comprising:

- setting up a plant (1) according to any one of the aspects from the 1st to the 58th;
- use pump (13) to pump working fluid in the liquid state into the closed circuit (2) said pump exploiting, for pumping, working fluid in the gaseous state coming from the closed circuit itself.

In a 62nd aspect according to the 61st aspect, the working fluid in the gaseous state used by the pump for pumping working fluid in the liquid state comes from a portion of the circuit (2) upstream of the expander used for mechanical and/or electrical power generation.

In a 63rd aspect according to any one of the four preceding aspects the process includes:

- bringing the working fluid to evaporation in the evaporator (3);
- expanding the working fluid exiting the evaporator (3) within the volumetric expander (4) and consequently producing mechanical or electrical energy by the generator (12) mechanically connected with the volumetric expander,
- condensing the working fluid exiting the volumetric expander (4) in the condenser (16),
- using the pump (13) to pump to the evaporator (3) working fluid in the liquid state coming from the condenser (16).

In a 64th aspect according to the preceding aspect said pump uses working fluid in the gaseous state produced by the evaporator (3) and tapped from the evaporator (3) itself or from the second portion (2*b*) of the closed circuit (2) included between the evaporator (3) and the volumetric expander (4) to pump toward the evaporator (3) said liquid working fluid from the condenser (16).

In a 65th aspect according to any one of the 58th through 64th aspects the process includes:

- receiving, in the second compartment (21) of the pump, pressurized gaseous working fluid from the second portion (2*b*) of the closed circuit (2), and moving the piston (15) so that the second head pushes the working fluid in the gaseous state present in the fourth compartment (23) in discharge to the third portion (2*c*) of the circuit specifically to the tank (17) while the first head pushes the working fluid in the liquid state present in the first compartment (20) to the first portion (2*a*) specifically to the evaporator (3),
- reached the stroke end, reverse the motion of the piston (15), such as by means of a control that moves the selector switch (53), and move the first head so as to increase the volume of the first compartment (20) and draw working fluid in the liquid state back into the same first compartment, with the fourth compartment (23) connected with the second portion of the circuit (2*b*) receiving fluid in the gaseous state and under high pressure produced by the evaporator, and with the second compartment (21) discharging working fluid in the gaseous state to the third portion (2*c*) of the circuit, specifically to the tank (17).

In a 66th aspect according to any one of the 58th through 64th aspects the process includes:

- receiving, into the second compartment (21) of the pump, working fluid in gaseous state and under pressure coming from the second portion (2*b*) of the closed circuit 2,
- operating the driving member (70) and moving the piston (15) so that the first head pushes the working fluid in the liquid state present in the first compartment (20) to the evaporator (3), at the same time loading gaseous, high-pressure working fluid generated by the evaporator (3) into the second compartment (21), reached the stroke end, reverse the motion of the piston (15), for example by means of a control that reverses the motion of the driving member (70), and move the first head so as to increase the volume of the first compartment (20) and draw working fluid in the liquid state from the third portion (2*c*) of the circuit (2) into the same first compartment, at the same time discharging fluid in the gaseous state from the second compartment (21) to the third portion (2*c*) of the circuit.

BRIEF DESCRIPTION OF DRAWINGS

Embodiments and aspects of the present invention will appear from the following description with reference to the accompanying drawings, which are provided by way of non-limiting example, wherein.

DEFINITIONS AND CONVENTIONS

Note that in the present detailed description corresponding parts shown in the various figures are indicated with the same numerical references.

The figures may illustrate the object of the invention by means of representations not to scale; therefore, parts and components illustrated in the figures related to the object of the invention could relate only to schematic representations.

With the term working fluid is, for example, understood to mean an organic-type fluid (ORC fluid). In particular, the working fluid that may be used with the described plant includes a quantity of organic fluid comprised between 90% and 99%, in particular between 95% and 99%, even more in particular around 98%. The organic-type fluid is preferably mixed with at least one oil configured for allowing lubrication of moving elements inside the volumetric expander. For example, the organic fluids used may include at least one selected among the group of the following fluids: R134A, R245FA, R1234FY, R1234FZ, R245 sas 3G, R 744, R32, R420, R520 (single ASHRAE).

The possibility of using other working fluids suitable for being used in the plant and process described here is not excluded.

In the following description and claims, the terms upstream and downstream refer to a direction of circulation of the working fluid within the closed circuit 2 of plant 1.

DETAILED DESCRIPTION

Parts Common to the Exemplifying Installations of FIGS. 1, 2 and 3, 4

Figure 1:
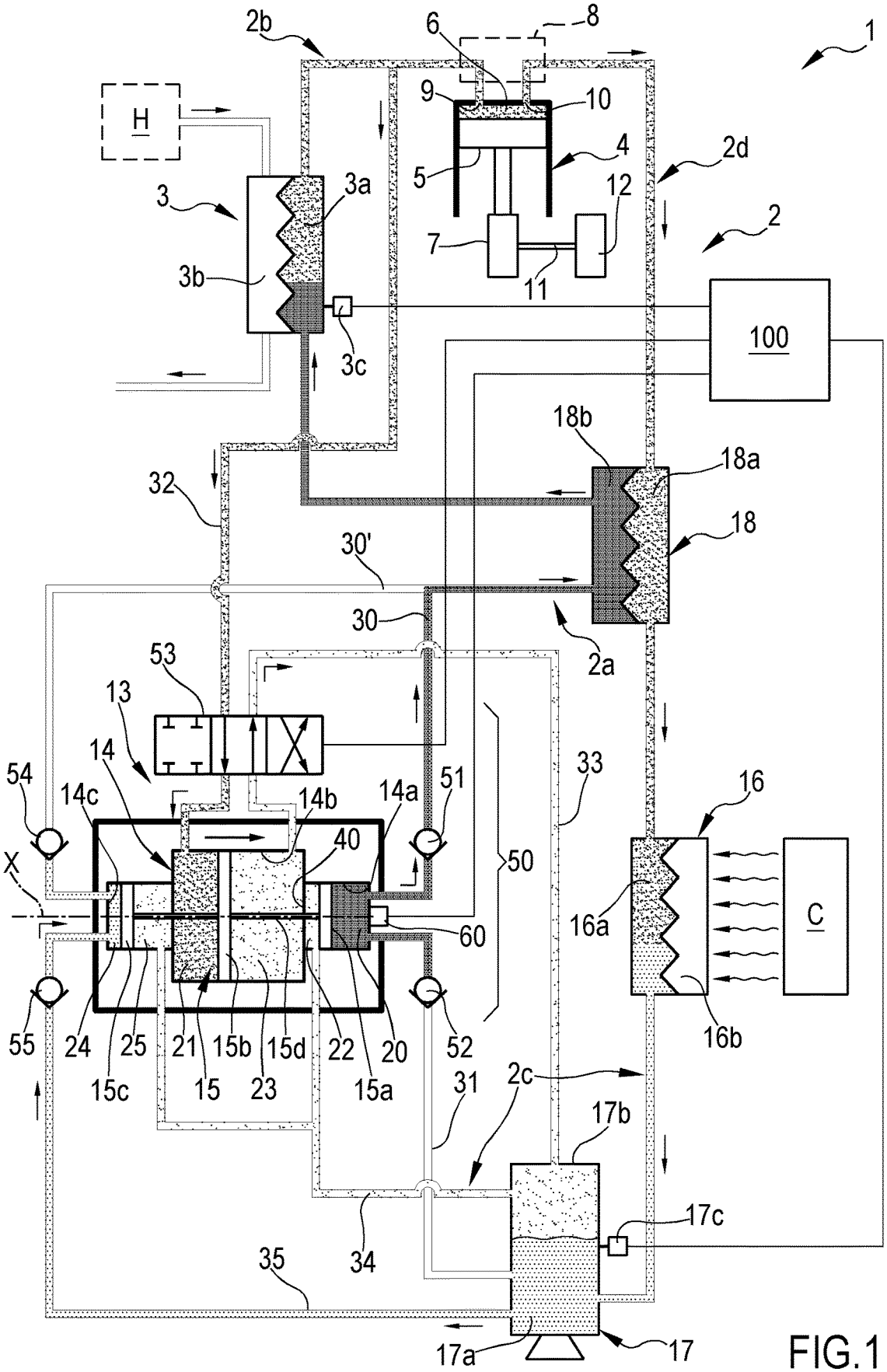
FIG. 1 is a schematic of a closed-loop plant of a first embodiment of the present invention and in a first operating condition.
Figure 2:
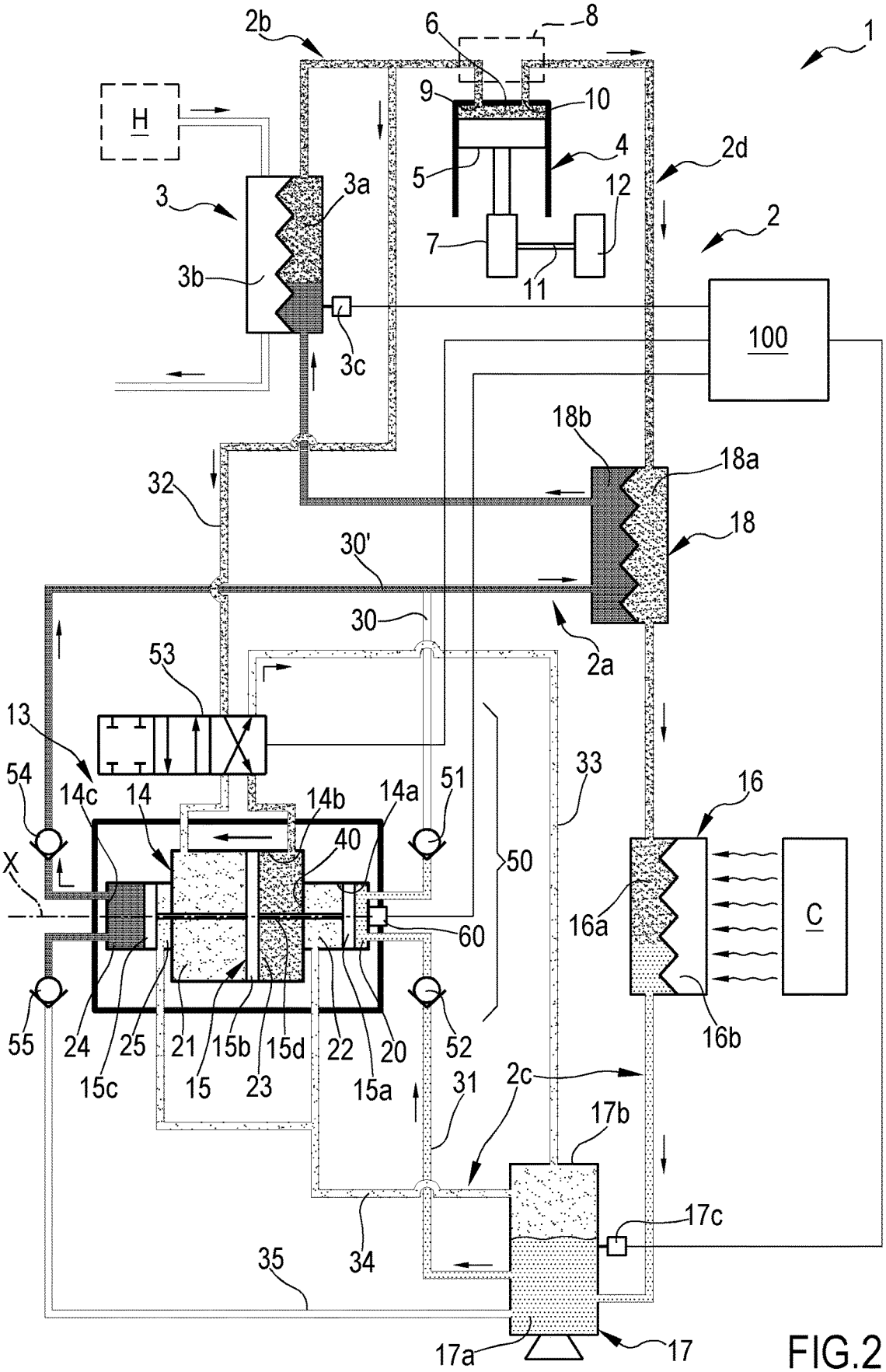
FIG. 2 is a schematic of the plant of FIG. 1 in a second operating condition.
Figure 3:
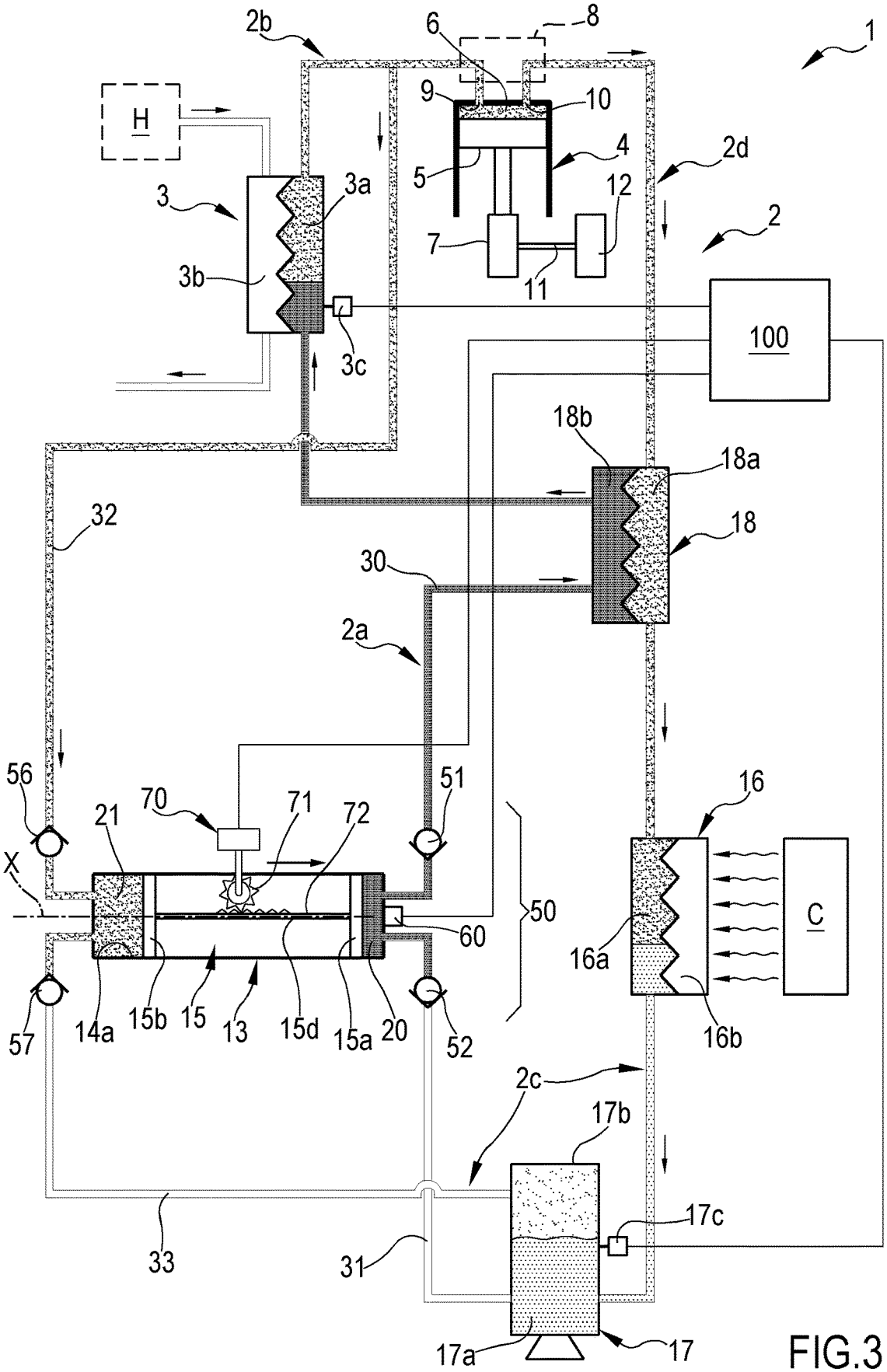
FIG. 3 is a schematic of a closed-loop plant of a second embodiment of the present invention and in a first operating condition.
Figure 4:
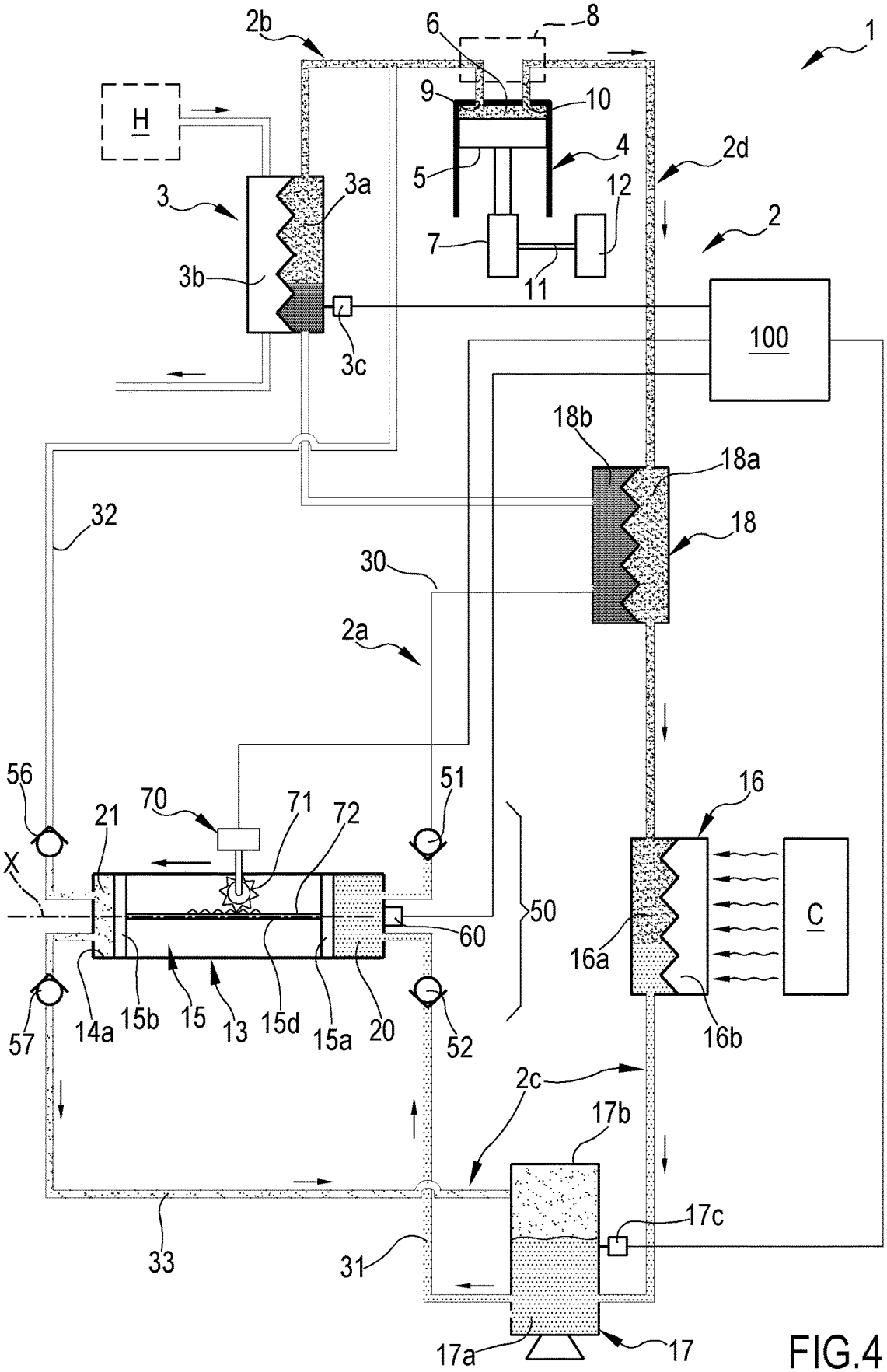
FIG. 4 is a schematic of the plant of FIG. 3 in a second operating condition.

The first part of the following description shown common aspects of the plant of FIGS. 1 and 2 and the plant of FIGS. 3 and 4.

With reference to the accompanying Figures from 1 to 4, with reference 1 has been indicated a closed-cycle plant, e.g., Rankine cycle, for the conversion of thermal energy into electrical and/or mechanical energy. The plant 1 finds application, for example, in biogas/biomass plants for recovery of waste heat from the cogeneration process, in geothermal plants for the exploitation of medium/small heat sources, in industrial plants for the recovery of waste heat (conversion of waste heat from industrial processes), in households for the production of electric energy and the exploitation of heat for sanitary use. A further use of the plant 1 may concern systems, both domestic and industrial, wherein the heat source is provided by systems exploiting solar energy. Uses of the plant in the automotive sector may also be envisaged, e.g. such as for the recovery of heat from the engine, or from flue gas or dissipated by the radiator.

The plant 1 includes a closed circuit 2 within which the working fluid circulates. In particular, the working fluid is a fluid of the type defined above.

As can be seen from the schematics of FIGS. 1-4, the plant 1 includes at least one pump 13 placed in circuit 2 and suitable for imposing the working fluid to move according to a predetermined direction of circulation.

The working fluid entering pump 13 is in the liquid state at a predetermined pressure, in particular substantially corresponding to a circuit minimum pressure. The pump 13 is configured for imposing a predetermined pressure jump on the working fluid and bringing it substantially to a maximum pressure of the circuit 2. The pressure jump imposed by the pump 13 depends on the sizing of the pump 13 and is preferably greater than 5 bar, in particular comprised between 5 bar and 25 bar, even more in particular between 5 bar and 20 bar. Due to the pressure jump imposed by pump 13, the working fluid circulates in the circuit 2 and in particular exiting the latter reaches a first heat exchanger or evaporator 3 active on the circuit 2. In fact, the working fluid in the liquid state pushed by pump 13 is fed into evaporator 3, which is configured to heat the fluid to the point of determining its transition from the liquid to the gaseous state.

In more detail, the evaporator 3 is suitable for receiving in passage the working fluid and in addition receive heat from a hot source H suitable for allowing the heating of said fluid by allowing its change of state: at the outlet of the evaporator 3 the working fluid is in a vapor condition, in particular saturated vapor. Structurally, the evaporator 3 may comprise, for example, one or more collection tanks (suitable for containing the liquid phase) and one or more heat exchanger(s) suitable for exploiting, as a hot source H, an additional working fluid e.g., arriving from a different industrial plant (e.g., industrial waste liquids) for transforming the working fluid from a liquid to a gas. Alternatively, the evaporator 3 may include a boiler suitable for allowing the working fluid to change state by means of a hot source H obtained by combustion. The heating fluid from the hot source may have a temperature lower than 150° C., in particular comprised between 25° C. and 130° C. In the example illustrated, the evaporator 3 comprises a first exchanger, with the working fluid flowing through a first side 3*a* of the first exchanger and being progressively converted to gas by a hot fluid from the hot source H connected to a second side 3*b* of the first exchanger 3. As can be seen from the figures, the fluids move against each other in the nonlimiting examples illustrated.

To the evaporator 3, and in particular to a liquid collection area of the evaporator, may be associated a level sensor 3*c* that is capable of reporting the level of liquid in the evaporator (e.g., in a tank associated with it): e.g., the level sensor 3*c* may comprise one or more sensor elements suitable for activating when a respective level is reached, or a transducer suitable for emitting an electrical or electromagnetic signal proportional to the liquid level, or a simple mechanical floating device suitable for sensing the liquid level and activating an electrical or mechanical control. The signal(s) from the level sensor 3*c* may be sent to a control unit 100 (e.g., comprising one or more digital CPUs associated respective memories or comprising one or more analog units or comprising a combination of one or more digital units associated with respective memories and one or more analog circuitry) programmed with at least one respective program or configured to selectively command the activation or shutdown of the pump 13 for fluid circulation, depending on the liquid level in the evaporator. Alternatively, the control unit 100 may be configured to command a valve assembly 50 associated to the pump 13 for hydraulically connecting or isolating the pump itself from the circuit 2 depending on the level sensed by the sensor 3*a*, or to command a driving member 70 of the pump 13. If the level sensor 3*a* is a mechanical device such as a float, the device may be kinematically connected to a switch of the pump for controlling the switching on or off the pump 53 or of the aforementioned driving member 70, or of at least one valve assembly associated with the pump to hydraulically isolate or not the pump itself from the circuit 2, depending on the level sensed by the sensor 17*c*.

Along the direction of circulation of the working fluid in the circuit 2, it is worth noting how the working fluid in the gaseous state exiting the evaporator 3 enters a volumetric expander 4 configured to transform the thermal energy of the working fluid into mechanical energy.

The volumetric expander 4 is of known type and for example comprises at least one piston 5 suitable for defining at least one expansion chamber 6 with variable volume. The volumetric expander 4 may further comprise a transmission member for example a crank gear 7 connected on one side to the piston and on the other side to a main shaft 11 configured to rotate about a respective axis. The volumetric expander 4 preferably includes at least one valve 8 configured for selectively allowing the working fluid to enter the chamber 6 through at least one inlet 9, the expansion of the fluid in the chamber 6 and the discharging of the working fluid from the expansion chamber 6 through at least one outlet 10 and thus generating the movement of the piston 5: so that, it is possible to rotate the main shaft 11 about its axis. It should be noted that a transmission part (not shown) connected—on one side—to the valve 8 and—on the other side—to the main shaft 11 can be provided to synchronize the inlet condition, the expansion condition and the discharge condition of the working fluid with the rotation of the main shaft 11 (alternatively, the synchronization can be managed by electrical or electronic systems), As can be seen, for example, from FIGS. 1 and 2, the plant 1 further includes at least one electric power generator 12 connected to the main shaft 11 and suitable for transforming the rotation of the latter in electric energy. In particular, the generator 12 may include at least one rotor connected to the main shaft 11 which is movable by rotation with respect to a stator. The relative movement between the rotor and the stator enables electric energy generation.

The volumetric expander 4 can obviously include more than one piston and for example can be of the type described in patent applications WO2010102874 and WO2014141072.

Along the direction of travel of the working fluid in the circuit 2, it can be seen that plant 1 also includes at least a second heat exchanger or condenser 16 active on the circuit 2 itself. The condenser 16, as seen for example in FIG. 1, is interposed between the expander 4 and the pump 13; the second heat exchanger or the condenser 16 is arranged to receive the working fluid exiting the expander 4 and allow it to change from a gaseous to a liquid state. In more detail, the condenser 16 is configured to receive on a first side 16*a* the working fluid and also to communicate with a cold source C which is suitable for subtracting heat from the fluid flowing through the condenser 16. The cold source maybe be, for example, the environment and may comprise one or more fans suitable for forcing cold air (i.e., at room temperature) towards the second side 16*b* of the heat exchanger or the condenser 16, preferably in counter-current with the flow of the working fluid flowing through the first side 16*a*. The working fluid, in its liquid state, exiting the condenser 16 returns to the inlet of pump 13.

The following description and claims will indicate as:

- first portion 2*a* of the closed circuit 2 that part of the closed circuit, extending downstream the pump 13 and upstream the evaporator 3, suitable for sending working fluid in the liquid state out of pump 13 to the evaporator 3 itself,
- second portion 2*b* of the closed circuit 2 the part of the closed circuit, extending upstream of the volumetric expander 4 and downstream the first portion 2*a*, which is suitable for receiving working fluid in the gaseous state generated by the evaporator 3 by sending it to the expander 4,
- third portion 2*c* of the closed circuit 2 the part of the closed circuit extending downstream the condenser 16 and upstream the pump 13, which is suitable for sending working fluid in the liquid state coming from the condenser 16 towards the pump and (as will be seen below) for collecting working fluid in the tank 17 discussed shortly,
- fourth 2*d* portion of the closed circuit 2 the part of the closed circuit extending downstream the expander 4 and upstream the condenser 16, which is suitable for sending expanded working fluid, but still in the gaseous state, to the condenser 16.

According to a further aspect, the working fluid in the liquid state is directed to a collection tank 17 located on circuit 2 between the condenser 16 and the pump 13. The function of the collection tank 17 is to collect and contain the working fluid in a liquid state exiting the condenser 16 at a lower zone 17*a* of the tank itself so that the pump 13 draws in liquid without bubbles, as shown in the accompanying figures. In particular, the tank 17 prevents the pumping of working fluid laden with air bubbles which could result in malfunction of the entire plant 1. The gas phase is in fact contained in the tank 17, which is not connected with the external environment, but part of the closed circuit, at an upper zone 17*b* of the tank itself. A level sensor 17*c* may be associated with the tank 17, and in particular with the lower liquid collection area 17*a* of the tank, which is suitable for providing the level of liquid in the tank: for example, the level sensor 17*c* may comprise one or more sensor elements capable of activating when a respective level is reached, or a transducer capable of emitting an electrical or electromagnetic signal proportional to the liquid level, or a simple mechanical float device capable of sensing the liquid level and activating an electrical or mechanical command. The signal(s) from the level sensor 17*c* can be sent to the control unit 100 programmed or configured to selectively command on or off the fluid circulation pump 13 or the driving member 70 depending on the liquid level in the tank 17. Alternatively, the control unit 100 may be configured to control a valve assembly 50 associated with the pump 13 to hydraulically connect or isolate the pump itself from the circuit 2 depending on the level sensed by the sensor 17*c*; if the level sensor 17*c* is a mechanical device such as a float, the device may be kinematically connected to a pump switch to control on or off of the pump 13 or the aforementioned driving member 70, or to at least one valve associated with the pump to isolate or not the pump itself from the circuit 2 depending on the level sensed by the sensor 17*c*.

According to a further aspect, the plant 1 includes at least a third heat exchanger 18 having a first side 18*a* crossed by a section of the fourth portion 2*d* of the closed circuit interposed between the expander 4 and the condenser 16 and a second side 18*b* crossed by a section of the first portion 2*a* of the closed circuit, for determining a preheating of the working fluid in a liquid state exiting the pump 13 and directed to the evaporator 3 by hot gas from expander 4.

Example of FIGS. 1 and 2

Turning now to a more detailed description of the pump 13 of FIGS. 1 and 2, it should first be noted that a plant with a single pump 13 is herein described, but there might be a plurality of pumps 13 for example operating in parallel or in series or in other configurations suitably inserted and synchronized.

The pump 13 shown in FIGS. 1 and 2 comprises a case 14 that defines within it at least a first and a second working chamber 14*a* and 14*b* that are hydraulically separated from each other and each defining a respective volumetry that can be occupied by the working fluid. As shown in FIGS. 1 and 2, the volumetry of the second chamber 14*b* is greater than the volumetry of the first chamber 14*a*: for example, the volumetry of the second chamber may be at least 1.5 or at least 2.0 times the volumetry of the first chamber.

Inside the case 14 operates a piston 15 presenting a first head 15*a* and a second head 15*b*. The first head 15*a* of the piston is slidingly housed in the first chamber 14*a* and the second head 15*b* of the piston is slidingly housed in the second chamber 14*b*; the first and second heads are then rigidly connected to each other. In the specific case, the first and second heads are connected by a rod 15*d* extending transversely to the same first and second heads 15*a*, 15*b* and passing fluid-tight through a separation wall 40 between the first and second chambers. As can be seen in FIGS. 1 and 2, the piston 15 moves back and forth within the case 14 along a predetermined axis X, with the first and second heads 15*a*, 15*b* then also moving back and forth in the respective first and second chambers 14*a*, 14*b*. The first and second chambers have a prismatic conformation and in particular cylindrical conformation, with the first and second heads also having cross sections (perpendicular to the axis X) having polygonal or, preferably, circular conformation, having to fluid-tight slide inside the respective chambers and therefore having a profile countershaped to the inner surface of the respective chambers. The stroke length of the first head in the first chamber is preferably equal to the one of the second head in the second chamber. Similarly, in the example shown, the extension along the axis X of the first chamber is equal to the extension along the same axis X of the second chamber, while the second chamber has a radial footprint significantly larger than the one of the first chamber: for example, the area of a section perpendicular to the axis X of the second chamber may be at least 1.5 or at least 2.0 times the area of a corresponding section perpendicular to the axis X of the first chamber. Consequently, the first head has a smaller active cross-sectional area (i.e., an area of the active thrust surface of the fluid measured orthogonally to the axis X) than the one of the second head: for example, the area of the active cross section of the second head may be at least 1.5 or at least 2.0 times the area of the active cross section of the second head.

The first head 15*a* of the piston delimits, in cooperation with the case 14, a first compartment 20, and a third compartment 22 opposed to the first compartment with respect to the same first head 15*a* (the first and third compartments 20, 22 are part of the first chamber 14*a*); in turn, the second head 15*b* delimits, in cooperation with said case, a second compartment 21 and a fourth compartment 23 opposed to the second compartment with respect to the second head 15*b* (the second and fourth compartments 21, 23 are instead part of the second chamber 14*b*). The separation wall 40 actually separates the third and fourth compartments 22, and 23 which are in the illustrated example adjacent to each other, but part of hydraulically distinct chambers i.e. the first chamber 14*a* and the second chamber 14*b* respectively. Summing up: the first head 15*a* of the piston separates the first chamber 14*a* into said first and third compartments 20, 22 of the pump which are in fact on opposite sides of the first piston head and having variable volume as the position of the first head in the first chamber varies, while the second head 15*b* of the piston separates the second chamber in the second and fourth compartments 21, 23 of the pump which are on opposite sides of the second piston head and also having variable volume as the position of the second head in the second chamber varies.

In the illustrated example, the pump 13 has piston 15 that optionally also includes a third head 15*c* rigidly connected to piston rod 15*d* and located opposite the first head (in practice, in the illustrated example, pump 13 and thus the piston 15 and the case 14 have symmetrical structure with the second head located in the middle of the piston between the first and third heads). The case 14 also defines a third chamber 14*c* in which the third head 15*c* operates, which divides the third chamber into a fifth and a sixth compartment 24 and 25, where the sixth compartment 25 is, for example, adjacent to the second compartment 21 and separated from the latter by an additional separation wall 41 through which the piston rod 15*d* fluid-tightly flows, and where the fifth compartment 24 is adjacent to the sixth compartment 25 and on opposite sides to the first compartment 20.

The first compartment 20 may be placed in fluid communication with a first portion 2*a* of the closed circuit 2 extending downstream the pump 13 and upstream the evaporator 3, to send working fluid in a liquid state to the same evaporator 3: for example, the first compartment 20 may present an outlet passage opening to which a line 30 of the first portion 2*a* of the circuit 2 is connected. The first compartment 20 is also connectable with a third portion 2*c* of the closed circuit 2: for example, the first compartment 20 may present an inlet passage opening connected to a line 31 of the third portion 2*c* of the circuit 2, upstream of the pump 13, to receive working fluid in a liquid state coming from the condenser 16 and more precisely from the lower zone 17*a* of the tank 17; in more detail, the first compartment is selectively configurable in a respective first operating condition (FIG. 1), in which said first compartment is in fluid communication with the line 30 and thus with the first portion 2*a* of the closed circuit 2, and in a respective second operating condition (FIG. 2), in which the first compartment is in fluid communication with the line 31 of the third portion 2*c* of closed circuit 2 upstream of pump 13 to receive working fluid in the liquid state from the tank 17.

The second compartment 21 can be placed in fluid communication with the second portion 2*b* of the closed circuit 2 by means of a line 32, in order to receive working fluid in a gaseous state generated by the evaporator 3 or by means of a line 33 with the upper zone 17*b* of the tank in order to discharge working fluid in the tank. In more detail, the second compartment 21 is selectively configurable in a respective first operating condition (FIG. 1), in which said second compartment is in fluid communication with the second portion 2*b* of the closed circuit 2 (through the line 32), and in a respective second operating condition (FIG. 2), in which the second compartment is in fluid communication with the third portion 2*c* of the closed circuit 2 (through the line 33) to discharge working fluid in a gaseous state into said third portion and in particular in the tank 17.

According to one aspect of the invention, the pump 13 is configured and controlled by the plant so that the first compartment 20 is in the respective first operating condition when the second compartment 21 is also in the respective first operating condition and so that the first compartment 20 is in the respective second operating condition when the second compartment 21 is also in the respective second operating condition; in this way, the pressurized gas coming from the second portion 2*b* and produced by the evaporator 3, which is therefore at high pressure (e.g., from 5 to 10 bar, typically around 20/25 bar higher than the liquid/gas pressure in the tank 17) tends, thanks to the larger size of the second piston 15*b*, to let the second pump compartment to expand and consequently cause a reduction in the volume of the first compartment pushing liquid working fluid to the evaporator. In practice, due to the above-described piston 15 and to the heads 15*a* and 15*b*, the pump 13 is configured so that changes of the internal volume of the first and second compartments are interconnected: in other words, following inlet of said working fluid in a gaseous state from the second portion 2*b* of the closed circuit into the second compartment 21 there is a movement of the second head (towards the right in FIG. 1) with an increase in the volume of the second compartment itself: this promotes a corresponding movement of the first head (also towards the right in FIG. 1 and of equal stroke) with a consequent reduction in the volume of the first compartment 20 causing the transfer of working fluid in a liquid state from the first compartment to said evaporator 3.

Thanks to this solution, it is possible to take advantage of a portion (actually relatively small) of the thermal energy of the hot, high-pressure gas present in the second portion 2*b* of the circuit to pump working fluid in a liquid state, significantly increasing the cycle efficiency, all without exploiting electric energy and thus improving the efficiency of the cycle.

As mentioned, according to one aspect, the first and second heads are connected to each other: in particular, in the non-limiting example of FIGS. 1 and 2, the first and second heads 15*a* and 15*b* are rigidly connected to each other by the rod 15*d*, so that they move back and forth synchronously. This implies that, when the first compartment and the second compartment are each in their respective first operating condition, working fluid in a gaseous state generated by the evaporator 3 enters the second compartment 21, contributes to moving the second head 15*b* of the piston in the direction of the first compartment, also determining the movement of the first head 15*a* and the expulsion of working fluid in the liquid state from the first compartment 20 and sending it towards said evaporator 3.

In the illustrated example the pump 13 has the piston 15 that optionally also includes a third head 15*c* rigidly connected to rod 15*d* and placed opposite to the first head conferring to the pump 13, and thus to piston 15 and to the case 14, symmetrical structure with the second head placed in the middle of the piston between the first and third heads: the third head operates in the third chamber 14*c* and divides it into the fifth and a sixth compartment 24 and 25.

In an optional and currently preferred solution, the third compartment 22 is in fluid communication with the third portion 2*c* of the closed circuit 2 upstream the pump 13: in particular, a service line 34 places the third compartment 22 in fluid communication with the upper zone 17*b* of the collection tank to receive or discharge working fluid in a gaseous phase, depending on whether the piston 15 is respectively moving in a first direction (e.g., towards the right with reference to FIG. 1) determining the discharge of liquid working fluid from the first compartment 20 or is moving in a second direction opposite to the first (toward the left with reference to FIG. 2) by drawing working fluid in a liquid state into the first compartment 20. Having gas from the tank 17 fed into the third compartment and not having high-temperature gas (e.g., from the portion 2*b*) prevents overheating of the liquid in the first compartment and thus the formation of bubbles during pumping. Similarly, the sixth compartment 26 (in case it is present) is in fluid communication with the third portion 2*c* of the closed circuit 2 upstream the pump 13: in particular, the service line 34 (or other line) places the sixth compartment 22 in fluid communication with the upper zone 17*b* of the collection tank to discharge or receive working fluid in a gas phase, depending on whether the piston 15 is respectively moving in a first direction (e.g., towards the right with reference to FIG. 1) resulting in the discharge of liquid working fluid from the sixth compartment 25 or it is moving in a second direction opposite to the first one (towards the left with reference to FIG. 2) for drawing in working fluid in a liquid state into the sixth compartment 25. Once again having gas from the tank 17 fed into the third compartment (and possibly into the sixth compartment) and not a high-temperature gas, prevents overheating the liquid in the first compartment (and in the fifth if present) and thus the formation of bubbles during pumping.

Alternatively, in a currently less preferred solution, it is possible to provide for the third compartment 22 (and possibly the sixth compartment 25 if present) to be selectively connectable to the second portion 2*b* of the circuit when the first compartment 20 (or the fifth compartment 24 if present) is in the first operating condition and pushing liquid to the evaporator 3 and to the third portion of the circuit 2*c* when the first compartment (or the fifth compartment if present) is in the second operating condition and drawing liquid from the third portion 2*c* of the circuit 2.

Finally, similarly to the second compartment 21, the fourth compartment 23 is selectively configurable in a respective first operating condition, in which said fourth compartment is in fluid communication with the second portion 2*b* of the closed circuit 2, e.g., through the line 32 (as will be seen thanks to the intervention of a valve assembly described below-condition shown in FIG. 2), and in a respective second operating condition, in which the fourth compartment is in fluid communication with the third portion 2*c* of the closed circuit 2 upstream pump 13 (thanks to the intervention of a valve assembly described below-condition shown in FIG. 1), for example through the line 33 leading to the upper zone 17*b* of the collection tank 17 to discharge working fluid in a gaseous state into the tank.

As shown in FIGS. 1 and 2, the pump 13 is driven so that the first compartment is in the first operating condition when the second compartment is in its first operating condition and the fourth compartment is in the respective second operating condition. Furthermore, the pump 13 is driven so that the first compartment is in the second operating condition when the second compartment is in its second operating condition and the fourth compartment is in the respective first operating condition. The third compartment is optionally always kept in the same operating condition with the tank 17, as discussed above.

If (as in FIGS. 1 and 2) the third head 15*c* and the third chamber 14*c* are present in the pump 13, these are in fact conformed and sized as the first head 15*a* and the first chamber 14*a*, respectively, and are connected to the circuit 2 so that when the first compartment 20 is in the first operating condition and pumps liquid to the second portion 2*b*, the fifth compartment is in its second operating condition and draws liquid from the third portion 2*c* (specifically from tank 17—see FIG. 1), for example, through a service line 35. Similarly, when the first compartment 20 is in the second operating condition, the fifth compartment 24 is in its first operating condition pushing liquid to the second portion 2*b* of the circuit, e.g., through a line 30' which, like the line 30, is connected to evaporator 3 (see FIG. 2).

As the skilled person may understand, various systems can be provided to drive the pump 13 and impose the operating conditions of the various compartments as described above. In the nonlimiting example shown in FIGS. 1 and 2, the plant is expected to include at least one valve assembly 50 cooperating with the pump 13 and configured to:

- placing the first compartment 20 of the pump selectively in the respective first or second operating condition,
- placing the second compartment 21 of the pump selectively in the respective first or second operating condition, in particular placing the first compartment 20 of the pump in the respective first operating condition when the second compartment 21 of the pump is also in the respective first operating condition and placing the first compartment 20 of the pump in the respective second operating condition when the second compartment 21 of the pump is also in the respective second operating condition,
- placing the fourth compartment 23 selectively in the respective first operating condition or second operating condition, in particular placing the fourth compartment 23 in the respective second operating condition when the second compartment (and thus also the first) is in the respective first operating condition and placing the fourth compartment in the respective first operating condition when the second compartment (and thus also the first) is in the respective second operating condition,
- if present placing the fifth compartment 24 in its second operating condition when the first compartment 20 is in its first operating condition, and placing the fifth compartment 24 in its first operating condition when the first compartment is in its second operating condition (for pumping working fluid to the evaporator 3 in both the stroke in one direction and the stroke in the opposite direction of the piston 13).

In detail, the valve assembly 50 exemplified in FIGS. 1 and 2 includes a first non-return valve 51 which may be physically carried by the body of the pump 13 (e.g., also directly associated with an outlet opening in the first compartment) or which may operate on the first portion 2*a* of the closed circuit (e.g., on the line 30), to allow the supply of working fluid in a liquid state exiting the first compartment 20 to said evaporator 3 (while preventing fluid from flowing back to the first compartment). For example, the valve assembly 50 also includes a second non-return valve 52 which may be carried by the body of the pump, e.g., also directly associated with an inlet opening in the first compartment 20, or which may operate on the third portion 2*c* of the closed circuit (e.g., placed on the line 31), to allow working fluid in a liquid state from the same third portion 2*c* (in particular, from the tank 17) to enter the first compartment, during a charging phase of the first compartment with working fluid. The valve assembly 50 shown in FIGS. 1 and 2 also includes a third non-return valve 54 which may be physically carried by the body of the pump 13 (e.g., directly associated with an outlet opening of the fifth compartment) or which may operate on the first portion 2*a* of the closed circuit (e.g., on the line 30'), to allow working fluid in a liquid state to flow outside of the fifth compartment to said evaporator 3 (while preventing fluid from flowing back towards the fifth compartment). The valve assembly 50 also includes, for example, a fourth non-return valve 55 which may be carried by the body of the pump, for example, also directly associated with an inlet opening in the fifth compartment 24 or operating on the third portion 2*c* of the closed circuit (for example, placed on the line 35), to allow working fluid in a liquid state from the same third portion 2*c* (in particular, from the tank 17) to enter the fifth compartment during a charging phase of the fifth compartment with working fluid.

The valve assembly 50 can also provide for the presence of a selector switch 53 having at least four ways and two positions, which can be selectively placed in a first position (FIG. 1) or a second position (FIG. 2). The selector switch 53, in the first position, places the fourth compartment 23 in the respective second operating condition (i.e., in fluid communication with the service line 33) while simultaneously placing the second compartment 21 in the respective first operating condition (i.e., in fluid communication with service line 32—see FIG. 1). The selector switch 53, in the second position, places the fourth compartment 23 in the respective first operating condition (i.e., in fluid communication with service line 32) simultaneously placing the second compartment in the respective second operating condition (i.e., in fluid communication with service line 33). In practice, the selector switch 53 alternately places the second or fourth compartment in communication with the line 32 and thus with the working fluid in a gaseous state present in the second portion 2*b* of circuit 2 or with the gas discharge line 33 to the tank 17. The selector switch 53 may also include a third position in which the switch closes fluid inlet and outlet from both the fourth and second compartments effectively blocking the pump 13 (in the examples in FIGS. 1 and 2 such a third position is provided but not selected).

Coordination of the selector switch 53 and thus its switching between the various positions described above may be done by an electronic, an electromechanical or purely a mechanical control system.

For example, it can be provided that control unit 100 sends a command to the selector switch to position it in one of the positions described above. For example, an end-stroke sensor 60 associated with the pump 13 can detect the attainment by said piston 15 of respective end-stroke positions and emit a corresponding command signal to the control unit 100, which can be configured to command the switch from the first to the second position of the selector based on said signal from the end-stroke sensor 60. Alternatively, the end-stroke sensor 60 can directly command the selector switch 53 to move between the first and second positions and vice versa.

As already mentioned, the control unit 100 may also be configured to control the valve assembly 50 and, in particular, the selector switch 53 associated with the pump 13, to appropriately connect or hydraulically isolate the pump itself with respect to the circuit 2 depending on the level sensed by the sensor 17*c* and/or depending on the level sensed by the level sensor 3*c* operating at the evaporator 3: e.g., if the level sensor sensed by level sensor 3*c* indicates a high liquid level, the control unit can be configured to turn off the pump by, for example, turning the selector switch to the third hydraulic lock position. Furthermore, the control unit can be configured to restart the pump and then set the selector switch to the first or second position (alternately) for pumping fluid in a liquid state to the evaporator if the level sensor 3*c* indicates a liquid level in the evaporator itself that is too low. Similarly, if the level sensor detected by level sensor 17*c* indicates a high liquid level, the control unit can be configured to activate the pump by, for example, turning the selector switch from the third hydraulic lock position alternately to the first and second positions. In addition, the control unit can be configured to stop the pump 13 and then set the selector switch to the third operating position if the level sensor 17*c* indicates a liquid level in the collection tank 17 that is too low.

If the level sensor 3*c* or 17*c* is a mechanical device such as a float, the device can be kinematically connected to selector switch 53 to control its movement towards the third position or outwards the third position and isolate or not the pump itself from the circuit 2, depending on the level sensed by the sensor 3*c* or 17*c*, respectively.

Finally, in a further variant, the pump 13 can be controlled by the control unit simply on a time basis determining the switching of the selector switch at predetermined regular intervals.

Example Shown in FIGS. 3 and 4

With reference to FIGS. 3 and 4, an embodiment is shown in which the pump 13 comprises a case 14 defining at least one chamber 14*a* within which operates a piston 15 having first and second heads 15*a*, 15*b* is slidingly housed in the chamber 14*a*. In the specific case, the first and second heads are connected by a rod or anther rigid body 15*d* extending transversely from the same first and second heads 15*a*, 15*b*. As can be seen from FIGS. 3 and 4, the piston 15 moves back and forth inside the case 14 along a prefixed axis X with the first and second heads 15*a*, 15*b* which then also move back and forth in the chamber 14*a*. The chamber 14*a* has a prismatic conformation and in particular preferably a cylindrical conformation, with the first and second heads also having cross sections (perpendicular to the axis X) having polygonal or, preferably, circular conformation, having to fluid-tight inside the chamber 14*a* and therefore having a profile countershaped to the inner surface of the respective chambers.

The first head 15*a* of the piston delimits, in cooperation with the case 14, a first compartment 20; in turn, the second head 15*b* delimits, in cooperation with said casing, a second compartment 21. Summing up: the first head 15*a* and the second head 15*b* define the compartments 20 and 21, which have variable volume as the position of piston 15 varies.

The first compartment 20 may be placed in fluid communication with a first portion 2*a* of the closed circuit 2 extending downstream the pump 13 and upstream the evaporator 3, for sending working fluid in a liquid state to the same evaporator 3: for example, the first compartment 20 may present an outlet passage opening to which a line 30 of the first portion 2*a* of the circuit 2 is connected. The first compartment 20 is also connectable with a third portion 2*c* of the closed circuit 2: for example, the first compartment 20 may present an inlet passage opening connected to a line 31 of the third portion 2*c* of the circuit 2, upstream the pump 13, to receive working fluid in a liquid state coming from the condenser 16 and more precisely from the lower zone 17*a* of the tank 17; in more detail, the first compartment is selectively configurable in a respective first operating condition (FIG. 3), in which said first compartment is in fluid communication with the line 30 and thus with the first portion 2*a* of the closed circuit 2 (but not with the third portion 2*c*), and in a respective second operating condition (FIG. 4), in which the first compartment is in fluid communication with the line 31 of the third portion 2*c* of the closed circuit 2 upstream of pump 13 to receive working fluid in a liquid state from the tank 17 (but not from the first portion 2).

The second compartment 21 can be placed in fluid communication, e.g., by means of a line 32, with the second portion 2*b* of the closed circuit 2 in order to receive working fluid in a gaseous state generated by the evaporator 3 or, e.g., by means of a line 33, with the third portion 2*c* and in particular with the upper zone 17*b* of the tank in order to discharge working fluid into the tank itself. In more detail, the second compartment 21 is selectively configurable in a respective first operating condition (FIG. 3), in which said second compartment is in fluid communication with the second portion 2*b* of the closed circuit 2 (through the line 32), and in a respective second operating condition (FIG. 4), in which the second compartment is in fluid communication with the third portion 2*c* of the closed circuit 2 (e.g., through the line 33) in order to discharge working fluid in a gaseous state in said third portion and in particular in the tank 17.

According to one aspect of the invention, the pump 13 is configured and controlled by the plant so that the first compartment 20 is in the respective first operating condition when the second compartment 21 is also in the respective first operating condition and so that the first compartment 20 is in the respective second operating condition when the second compartment 21 is also in the respective second operating condition; in this way, the pressurized gas from the second portion 2*b* and produced by the evaporator 3, which is at high pressure (e.g., at a pressure from 5 bar to 10 bar, typically from 20 bar to 25 bar higher than the pressure of the working fluid in the tank 17) entering the second compartment of the pump tends to equalize the pressure in the first compartment. Due to the aforementioned piston 15 and the heads 15*a* and 15*b*, the pump 13 is configured so that the internal volume variations of the first and second compartments are interconnected: in other words, a small force given by a driving member 70 associated with pump 13 (sufficient to overcome friction) is sufficient to cause the displacement of the piston 15 and, following entry of said working fluid in a gaseous state from the second portion 2*b* of the closed circuit in the second compartment 21, having a movement of the second head 15*b* (towards the right in FIG. 3) with an increase in the volume of the second compartment itself: it promotes a corresponding movement of the first head 15*a* (also towards the right in FIG. 3) with a consequent reduction in the volume of the first compartment 20 causing the transfer of working fluid in a liquid state from the first compartment to said evaporator 3.

Thanks to this solution, it is possible to take advantage of a portion (actually relatively small) of the thermal energy of the hot, high-pressure gas present in the second portion 2*b* of the circuit for promoting pumping the working fluid.

As mentioned in the example in FIGS. 3 and 4, the pump 13 includes driving member 70, which can optionally be an electric motor or hydraulic motor or electric actuator or hydraulic actuator or pneumatic actuator. The driving member 70 is active on the piston 15 for determining its movement back and forth along a predetermined stroke within said case at very low energy consumption (e.g., electric). For example, FIGS. 3 and 4 show a driving member 70 connected to a pinion 71 acting on a rack 72 carried by the piston 13 for moving back and forth the piston itself along its operating stroke and thereby determining the pumping of liquid working fluid to the evaporator. Other connections between the member 70 and the piston 11 may be provided. The control unit 100 can control the driving member 70 in a direction or the other by commanding the reversal of motion on the basis of a signal from one or more end-stroke sensors 60 carried by the pump and communicatively connected with the unit 100 or on the basis of predetermined time intervals.

Also in the example in FIGS. 3 and 4, a valve assembly 50 may be provided cooperating with pump 13 and configured for:

- placing the first compartment of the pump selectively in the respective first or second operating condition;
- placing the second compartment of the pump selectively in the respective first or second operating condition, in particular placing the first compartment in the respective first operating condition when the second compartment is in the respective first operating condition and placing the first compartment in the respective second operating condition when the second compartment is in the respective second operating condition.

The valve assembly 50 may, for example, comprise a first non-return valve 51, which may be physically carried by the body of the pump 13 (e.g., also directly associated with an outlet opening in the first compartment) or operating on the first portion 2*a* of the closed circuit (e.g., located on the line 30), to allow working fluid in a liquid state to be supplied from the first compartment to said evaporator 3 (while preventing fluid from flowing back to the first compartment). The valve assembly 50 also includes, for example, a second non-return valve 52, which may be carried by the body of the pump, for example also directly associated with an inlet opening in the first compartment 20 or operate on the third portion 2*c* of the closed circuit (for example on the line 31), to allow working fluid in a liquid state from the same third portion 2*c* (in particular from the tank 17) to enter the first compartment, during a charging phase of the first compartment with working fluid.

The valve assembly 50 may also comprise a third non-return valve 56 which may be physically carried by the body of the pump 13 (e.g., directly associated with an inlet opening of the second compartment) or operate on the second portion 2*b* of the closed circuit (e.g., on the line 32), to allow working fluid in the gaseous state generated by said evaporator 3 to be supplied to the second compartment (while preventing fluid from flowing back to the evaporator). The valve assembly 50 also includes, for example, a fourth non-return valve 57, which may be carried by the body of the pump, for example, directly associated with an outlet opening from the second compartment 21 or operate on the third portion 2*c* of the closed circuit (for example, on the line 33), to allow working fluid in the gaseous state to flow outward the second compartment to the same third portion 2*c* (in particular towards the tank 17), during a discharge phase of working fluid from the second compartment.

Alternatively to the above, the valve assembly 50 could include a selector switch, e.g., a four way two position (or other valve selector), e.g., controlled by the unit 100, capable of enabling the positioning of the first and second compartments under the operating conditions described above.

Although a pump using a piston with multiple heads has been described in the examples shown above, it is possible to provide instead of the piston, the use of diaphragms or membranes (acting as the heads and defining the various compartments) kinematically connected to each other so that they can ensure similar pump functionality as described above with the compartments operating as illustrated above.

Furthermore, although a pump using a reciprocating type piston has been described in the examples above, it is not excluded the possibility of using a 'rotary piston' system.

Process of Producing Electrical and/or Mechanical Energy.

It is also an object of the present invention a process using one of the above-described plants or a plant according to any one of the accompanying claims for converting thermal energy into mechanical or electrical energy. The process includes a step of circulating the working fluid whose motion is given by the pump 13. The working fluid, pushed by the pump 13 reaches the evaporator 3 which, thanks to the hot source H heats the working fluid until it evaporates.

The process may also have a preheating phase for the working fluid by means of the economizer or third heat exchanger 18. For example, the preheating phase allows the working fluid to be heated without causing evaporation of the working fluid. The heat for preheating is taken from the expanded gas leaving the expander 4.

Following the evaporation phase, the working fluid in the gaseous state reaches the expander 4: here the fluid is expanded and causes the rotation of the motor shaft 11 with generation of mechanical energy that could be directly used. In detail, as a result of this expansion, the piston 5 of the expander is moved, in a known manner, in an alternating (reciprocating expander) or rotary (rotary expander) direction, thus rotating the shaft 11 which produces mechanical energy that, for example, can be directly used if the shaft 11 is connected to a user device or system. Alternatively, the shaft 11 can be connected with an electric generator 12 to produce electricity that can be appropriately stored, distributed to the grid, or used immediately. The flow of gas exiting the expander 4 then reaches the hot side of the economizer 18, if present, and then proceeds to the condenser 16 in which said fluid is condensed and sent to the tank 17.

The tank 17 is in fluid communication with the pump 13, which draws directly from the lower zone 17*a* of said tank to circulate the working fluid back into the circuit. In more detail, the tank 17 is interposed between the condenser 16 and the pump 13 and allows for the accumulation of working fluid in a liquid state: in this condition, the tank 17 ensures that the pump 13 draws in liquid while preventing any air bubbles from being drawn in, thus ensuring a continuous supply of liquid.

In the case of the example of FIGS. 1 and 2, the pumping of liquid occurs as follows. Starting, for example, from a condition where the piston 15 of the pump 13 is at an end of stroke position and moves in one of its strokes (e.g., from left to right as shown in FIG. 1) to the opposite end of stroke position, the second compartment 21 of the pump receives pressurized gas from line 32 i.e., from the second portion 2*b* of the closed circuit 2. Due to the larger cross-sectional area of the second head 15*b* compared to the first head 15*a*, the piston is moved so that the second head pushes the fluid in a gaseous state present in the fourth compartment 23 in discharge towards the tank 17 while the first head 15*a* pushes the working fluid in a liquid state present in the first compartment 20 toward the evaporator 3, specifically through the line 30. At this stage, fluid in a gaseous state from the upper zone 17*b* of the tank is simultaneously loaded into the third chamber 22, which preferably is constantly in fluid connection with the upper zone of the tank. In the example of FIGS. 1 and 2, it is also planned that the third head 15*c* moves into the third chamber 14*c* increasing the volume of the fifth compartment 24 that draws in fluid in a gaseous state, e.g., thanks to the line 35, from the lower zone 17*a* of tank 17. At the same time, fluid in a gaseous state present in the sixth compartment 25 is discharged into the upper zone 17*b* of the tank, since the sixth compartment is preferably in constant fluid communication with the tank 17 itself.

Once the end of stroke (the right end of stroke shown in FIG. 1) is reached, the motion of the piston 15 is reversed (as already discussed, for example, through a command that moves the selector switch 53 from the position in FIG. 1 to that in FIG. 2) and the first head 15*a* moves so as to increase the volume of the first compartment 20, which then draws working fluid in the liquid state into the same first compartment 21 (see FIG. 2). At the same time, the third head 15*c* (if present) pushes the working fluid contained in the fifth compartment towards the evaporator 3, e.g., through the line 30'. At this stage, following an appropriate operation of the selector switch (FIG. 2) the fourth compartment 23 is connected with the second portion of circuit 2*b* and it receives fluid in a gaseous state and at high pressure produced by the evaporator. Said fluid entering the fourth compartment, due to the larger cross-sectional area of the second head 15*b* compared to the first and third heads, pushes the second head 15*b* in the opposite direction to the one of FIG. 1 so as to gradually reduce the volume of the second chamber 21, which at this stage discharges fluid in a gaseous state to the upper zone 17*b* of the tank 17. At the same time, as mentioned above, the motion of the piston 15 results in the pumping of fluid in the gaseous state contained in the fifth compartment 24 (if any) towards the expander 3. In the described phase (FIG. 2), fluid in a gaseous state in the third chamber 22, which preferably is constantly in fluid connection with the upper zone of the tank, is discharged into the tank. At the same time fluid in the gaseous state from the upper zone 17*b* of the tank is received in the sixth compartment 25, since the sixth compartment is preferably in constant fluid communication with the tank 17 itself.

During the steps described, non-return valves 51, 52, 54 and 55 allow the fluid to move in one direction only:

- the valve 51 allows supplying fluid in a liquid state from the first compartment 20 to the evaporator 3, but prevents the return of working fluid from the evaporator to the first compartment 20,
- the second valve 52 allows supplying working fluid in a liquid state from the tank 17 to the first compartment 20, but prevents the discharge of fluid from the same first compartment 20 to the tank 17,
- the third valve 54 allows the flow of working fluid in a liquid state from the fifth compartment 24 to the evaporator 3, but prevents the return of working fluid from the evaporator to the fifth compartment 24,
- finally, the valve 55 allows supplying working fluid in a liquid state from the tank 17 to the fifth compartment 24, but prevents the discharge of fluid from the same fifth compartment 24 to the tank 17.

In the case of the example of FIGS. 3 and 4, the pumping of liquid occurs as follows. Starting, for example, from a condition where the piston 15 of the pump 13 is at an end of stroke position and moves in one of its strokes (e.g., from left to right as shown in FIG. 3) to the opposite end of stroke position, the second compartment 21 of the pump receives pressurized gas from the line 32 i.e., from the second portion 2*b* of the closed circuit 2. Due to the activation of the driving member 70 and since the pressure in the first compartment 20 is not higher than that in the second compartment, the piston is moved so that the first head 15*a* pushes the working fluid in the liquid state present in the first compartment 20 towards the evaporator 3, in particular through the line 30.

Once the end of stroke (the right end of stroke shown in FIG. 3) is reached, the motion of the piston 15 is reversed (as discussed above, e.g., by means of a command that reverses the motion of the driving member 70), and the first head 15*a* moves so as to increase the volume of the first compartment 20, which then draws in working fluid in a liquid state in the same first compartment (see FIG. 4) coming from the lower zone 17*a* of tank 17. At the same time, fluid in a gaseous state in the second compartment 21 is discharged to the upper zone 17*b* of tank 17.

During the steps described, non-return valves 51, 52, 56 and 57 allow the fluid to move in one direction only:

- the valve 51 allows supplying fluid in a liquid state from the first compartment 20 to the evaporator 3, but prevents the return of working fluid from the evaporator to the first compartment 20,
- the second valve 52 allows supplying working fluid in a liquid state from the tank 17 to the first compartment 20, but prevents the discharge of fluid from the same first compartment 20 to the tank 17,
- the third valve 56 allows the flow of working fluid in a gaseous state from the evaporator 3 to the second compartment, but prevents the return of working fluid from the second compartment 21 to the evaporator,
- finally, the fourth valve 57 allows discharging working fluid in a gaseous state from the second compartment 21 to the tank 17, but prevents the return of fluid from the tank to the second compartment 21.

By means of the solutions described and claimed, it is possible to exploit some of the energy in the working fluid to determine or support the pumping of that fluid in the closed circuit 2, resulting in an increase in overall efficiency of the cycle.

In addition, the type of pump having a piston 13 described above is suitable for being reliably used as it is of simple design and capable of operating at high pressure jump values having no sealing problems, likewise requiring little maintenance.

It should also be noted how the plant and process are completely or almost completely self-sustained in terms of energy.

Furthermore, by means of an appropriate driving of the pump 13, cavitation issues can be totally avoided.

The invention claimed is:

1. A plant for converting thermal energy into electrical and/or mechanical energy comprising:

- a closed circuit for circulation of a working fluid,
- a pump operative in the closed circuit for circulating the working fluid in the closed circuit, an evaporator active on the closed circuit and configured to receive heat from a hot source (H) and heat the working fluid to cause its transition from liquid to gaseous state, an expander operative in the closed circuit downstream of the evaporator and configured for receiving incoming working fluid in gaseous state, a condenser active on the closed circuit downstream of the expander and upstream of the pump, said condenser being configured for determining transition of the working fluid from gaseous to liquid state, wherein the pump comprises:

a casing, and a piston operating within the casing, wherein the piston has a first head delimiting, in cooperation with said casing, a first compartment, and a second head delimiting, in cooperation with said casing, a second compartment, wherein the first compartment is positionable in fluid communication with a first portion of the closed circuit, extending downstream of the pump and upstream of the evaporator to send working fluid in liquid state towards the same evaporator, and wherein the second compartment is positionable in fluid communication with a second portion of the closed circuit, extending downstream of said first portion and upstream of the expander to receive working fluid in gaseous state generated by the evaporator.

2. The plant of claim 1, wherein the first and second heads are rigidly connected to each other, and wherein:

when said first compartment and said second compartment are each in their respective first operating condition, gaseous working fluid generated by said evaporator entering said second compartment contributes to move the second head of said piston, also determining the movement of said first head and expulsion of liquid working fluid from said first compartment and supply of the same towards said evaporator.

3. The plant of claim 1, wherein the first and second heads are rigidly connected to each other, and wherein:

when said first compartment and said second compartment are each in their respective second operating condition, liquid working fluid entering said first compartment contributes to move the first head of said piston, determining also the movement of said second head and expulsion of working fluid in gaseous state from said second compartment with supply of the same towards a third portion of said closed circuit extending downstream of said condenser and upstream of said pump.

4. A plant according to claim 1, wherein the pump is configured to increase volume of the second compartment following entry of said working fluid in gaseous state coming from the second portion of the closed circuit into the same second compartment, and consequently to reduce volume of the first compartment causing the transfer of working fluid in liquid state towards said evaporator.

5. A plant according to claim 1, wherein the first compartment is selectively configurable in a respective first operating condition, where said first compartment is in fluid communication with the first portion of the closed circuit, and in a respective second operating condition, where the first compartment is in fluid communication with a third portion of the closed circuit extending downstream of the condenser and upstream of the pump to receive working fluid in a liquid state coming from the condenser; and wherein the second compartment is selectively configurable in a respective first operating condition, where said second compartment is in fluid communication with the second portion of the closed circuit, and in a respective second operating condition, where said second compartment is in fluid communication with the third portion of the closed circuit upstream of the pump to discharge working fluid in a gaseous state into said third portion.

6. A plant according to claim 5, wherein the plant is configured to hold the first compartment in the respective first operating condition when the second compartment is in the respective first operating condition and to hold the first compartment in the respective second operating condition when the second compartment is in the respective second operating condition.

7. A plant according to claim 1, comprising a collection tank operating at the third portion of the closed circuit and interposed between the condenser and the pump, said collection tank being configured to receive working fluid from the condenser and to contain working fluid in liquid state in equilibrium with working fluid in gaseous state;

wherein the first compartment, in the respective second operating condition, is in fluid communication with a lower zone of the collection tank to receive working fluid in liquid state from the collection tank; wherein the second compartment, in the respective second operating condition, is in fluid communication with an upper zone of the collection tank to discharge working fluid in gaseous state into the collection tank.

8. A plant according to claim 1, wherein the enclosure defines at least a first and a second working chamber hydraulically separated from each other and each defining a respective volume that can be occupied by the working fluid;

wherein the volume of the second chamber is greater than the volumetry of the first chamber, or wherein the of the second chamber is at least 1.5 times greater than the volumetry of the first chamber.

9. A plant according to claim 8, wherein the first and second chambers have equal axial extension in the direction of piston motion and different cross section; wherein the first head is slidingly housed in the first chamber and the second head is slidingly housed in the second chamber, the first and second heads being rigidly connected by a rod extending transversely to the first and second heads and passing through a separation wall between the first and second chambers, and wherein the first head has an active cross-sectional area smaller than that of the second head.

10. A plant according to 8, wherein the first piston head separates the first chamber into said first compartment and into a third compartment of the pump, said first and third compartments extending on opposite sides of the first piston head and presenting variable volume as the position of the first head in the first chamber varies;

wherein the second piston head separates the second chamber into said second compartment and into a fourth compartment of the pump, said second and fourth compartments extending on opposite sides of the second piston head and presenting variable volume as the position of the second head in the second chamber varies; wherein the first compartment is adjacent to the third compartment which is adjacent to the fourth compartment which in turn is adjacent to the second compartment.

11. A plant according to claim 10, wherein the third compartment is in fluid communication with the third portion of the closed circuit upstream of the pump;

wherein the fourth compartment is selectively configurable in a respective first operating condition, wherein said fourth compartment is in fluid communication with the second portion of the closed circuit, and in a respective second operating condition, wherein said fourth compartment is in fluid communication with the third portion of the closed circuit upstream of the pump.

12. A plant according to claim 10, wherein the plant is configured to hold the fourth compartment in the respective second operating condition when the second compartment is in the respective first operating condition and hold the fourth compartment in the respective first operating condition when the second compartment is in the respective second operating condition.

13. A plant according to claim 5, comprising a valve assembly cooperating with the pump and configured to:

set the first compartment of the pump selectively to the respective first or second operating condition;

set the second compartment of the pump selectively to the respective first or second operating condition;

wherein the valve assembly is configured to place the first compartment of the pump in the respective first operating condition when the second compartment is in the respective first operating condition and to place the first compartment in the respective second operating condition when the second compartment is in the respective second operating condition.

14. A plant according to claim 13, wherein the valve assembly comprises:

a first non-return valve, operative on the first portion of the closed circuit, to supply to said evaporator of working fluid in liquid state exiting from the first compartment, a second non-return valve, operative on the third portion of the closed circuit, to allow entry into the first compartment of working fluid in liquid state coming from the same third portion, a third non-return valve, operative on a service line connecting the second compartment with the second portion of the closed circuit, to allow entry of working fluid in gaseous state generated by the evaporator into the second compartment, a fourth non-return valve, operative on a further service line connecting the second compartment with the third portion of the closed circuit, to discharge working fluid in gaseous state from the second compartment into the same third portion of the closed circuit.

15. A plant according to claim 13, wherein the valve assembly is further configured to:

place the fourth compartment selectively in the respective first operating condition or second operating condition, and place the fourth compartment in the respective second operating condition when the second compartment is in the respective first operating condition, vice versa placing the fourth compartment in the respective first operating condition when the second compartment is in the respective second operating condition;

wherein the valve assembly comprises:

a first non-return valve, operative on the first portion of the closed circuit, to supply said evaporator of working fluid in liquid state exiting from the first compartment, a second non-return valve, operative on the third portion of the closed circuit, to allow entry into the first compartment of working fluid in liquid state coming from the same third portion, a selector switch having at least four ways and two positions, wherein the selector switch, in a first position, sets the fourth compartment in the respective second operating condition while simultaneously setting the second compartment in the respective first operating condition, and wherein selector switch, in a second position, sets the fourth compartment in the respective first operating condition while simultaneously setting the second compartment in the respective second operating condition.

16. A plant according to claim 1, comprising:

a level sensor associated with the evaporator and/or a level sensor associated with the tank;

a control unit, wherein the control unit is communicatively connected with the level sensor associated with the evaporator, said level sensor sending at least a corresponding signal relative to the level of liquid in the evaporator to the control unit, which is configured to receive said signal and, depending on said signal, control or not activation of the pump, and/or wherein the control unit is communicatively connected with the level sensor associated with the tank, said level sensor sending at least a corresponding signal relative to the level of liquid in the tank to the control unit, which is configured to receive said signal and, depending on said signal, to control or not the activation of the pump.

17. A plant according to claim 1, wherein the plant comprises:

an end-stroke sensor associated with said pump for detecting attainment by said piston of respective end-stroke positions and wherein the end-stroke sensor is configured to directly control the reversal of the motion of said piston or the end-stroke sensor is configured to emit a corresponding command signal to a control unit which is configured to command the reversal of the motion of said piston; or a control unit configured to control the reversal of the motion of said piston at predetermined regular time intervals.

18. A plant according to claim 1 comprising an electrical power generator connected to the volumetric expander;

wherein said volumetric expander comprises:

a piston defining an expansion chamber with variable volume, a main shaft kinematically connected to the piston and configured to turn about a main axis, a valve configured to selectively open and close an inlet and an outlet of the expansion chamber allowing at least:

a working fluid input condition in the expansion chamber, a condition of expansion of the working fluid in the expansion chamber, and a condition of discharge of the working fluid from said expansion chamber;

wherein said power generator is connected to the main shaft.

19. A plant for converting thermal energy into electrical and/or mechanical energy comprising:

a closed circuit for circulation of a working fluid, a pump operative in the closed circuit for circulating the working fluid in the closed circuit, an evaporator active on the closed circuit and configured to receive heat from a hot source (H) and heat the working fluid to cause its transition from liquid to gaseous state, an expander operative in the closed circuit downstream of the evaporator and configured for receiving incoming working fluid in gaseous state, a condenser active on the closed circuit downstream of the expander and upstream of the pump, said condenser being configured for determining transition of the working fluid from gaseous to liquid state, wherein the pump comprises:

a first compartment positionable in fluid communication with a first portion of the closed circuit, extending downstream of the pump and upstream of the evaporator to send working fluid in liquid state towards the same evaporator, and a second compartment positionable in fluid communication with a second portion of the closed circuit, extending downstream of said first portion and upstream of the expander to receive working fluid in gaseous state generated by the evaporator;

wherein said evaporator comprises at least a first heat exchanger having a side configured to receive heat from a hot source and a side crossed by said second portion of the closed circuit;

wherein the condenser comprises a second heat exchanger having a side crossed by a section of the third portion of the closed circuit interposed between the expander and the pump, and a side configured to interact with a cold source and allow condensation of the working fluid crossing said section, determining its passage from gaseous to liquid state; and wherein the plant comprises at least a third heat exchanger having a side crossed by a section of the closed circuit interposed between the expander and the condenser and a side crossed by a section of the first portion of the closed circuit, to determine a preheating of the working fluid in liquid state exiting from the pump and directed towards the evaporator.

20. A plant for converting thermal energy into electrical and/or mechanical energy comprising:

a closed circuit for circulation of a working fluid, a pump operative in the closed circuit for circulating the working fluid in the closed circuit, an evaporator active on the closed circuit and configured to receive heat from a hot source (H) and heat the working fluid to cause its transition from liquid to gaseous state, an expander operative in the closed circuit downstream of the evaporator and configured for receiving incoming working fluid in gaseous state, a condenser active on the closed circuit downstream of the expander and upstream of the pump, said condenser being configured for determining transition of the working fluid from gaseous to liquid state, wherein the pump comprises:

a first compartment positionable in fluid communication with a first portion of the closed circuit, extending downstream of the pump and upstream of the evaporator to send working fluid in liquid state towards the same evaporator, and a second compartment positionable in fluid communication with a second portion of the closed circuit, extending downstream of said first portion and upstream of the expander to receive working fluid in gaseous state generated by the evaporator;

wherein the plant further comprises a collection tank operating at a third portion of the closed circuit and interposed between the condenser and the pump, said collection tank being configured to receive working fluid from the condenser and to contain working fluid in liquid state in equilibrium with working fluid in gaseous state.

21. A plant according to claim 20, wherein the first compartment, in the respective second operating condition, is in fluid communication with a lower zone of the collection tank to receive working fluid in liquid state from the collection tank; wherein the second compartment, in the respective second operating condition, is in fluid communication with an upper zone of the collection tank to discharge working fluid in gaseous state into the collection tank.

* * * * *